US012584484B2

(12) United States Patent
Yoshimura et al.

(10) Patent No.: US 12,584,484 B2
(45) Date of Patent: Mar. 24, 2026

(54) ELECTRIC LIQUID PUMP

(71) Applicant: TOYODA GOSEI CO., LTD., Kiyosu (JP)

(72) Inventors: Mitsuhiro Yoshimura, Aichi-ken (JP); Shinya Sakai, Aichi-ken (JP); Satoshi Suzuki, Aichi-ken (JP); Naoki Nishimoto, Aichi-ken (JP); Kentaro Kuroda, Aichi-ken (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 19/080,302

(22) Filed: Mar. 14, 2025

(65) Prior Publication Data

US 2025/0297605 A1 Sep. 25, 2025

(30) Foreign Application Priority Data

Mar. 20, 2024 (JP) ..... 2024-044307

(51) Int. Cl.
*F04C 11/00* (2006.01)
*F04C 2/08* (2006.01)
(Continued)

(52) U.S. Cl.
CPC ..... *F04C 11/008* (2013.01); *F04C 2/084* (2013.01); *F04C 2/086* (2013.01); *F04C 2/10* (2013.01);
(Continued)

(58) Field of Classification Search
CPC ..... F04C 11/008; F04C 2/084; F04C 2/086; F04C 2/10; F04C 2/102; F04C 15/008;
(Continued)

(56) References Cited

U.S. PATENT DOCUMENTS 7,036,892 B2 * 5/2006 Suzuki ..... H02K 7/14 303/116.4
7,156,623 B2 * 1/2007 Sakakibara ..... F04C 2/102 417/310
(Continued)

FOREIGN PATENT DOCUMENTS

JP 2020165375 A 10/2020
JP 2023004065 A 1/2023
(Continued)

*Primary Examiner* — Peter J Bertheaud
(74) *Attorney, Agent, or Firm* — Posz Law Group, PLC

(57) ABSTRACT

An electric liquid pump has a motor, a liquid pump including an inner rotor having an external tooth and integrated with an axial end of a shaft of the motor and an outer rotor having an internal tooth meshing with the external tooth and forming a gap, a motor case having a box shape and including therein first and second accommodation chambers and a partition wall, and a body including a centering body portion, a general body portion, and a bearing portion formed to penetrate the centering body portion and the general body portion. The motor case and the body are made of resins. A connection body portion extends in a radial direction of the shaft. A connection case portion extends in the radial direction. The connection body portion and the connection case portion are provided with attachment portions having a through-hole-shape at positions facing each other.

7 Claims, 3 Drawing Sheets

(51) Int. Cl.

| | |
|---|---|
| ***F04C 2/10*** | (2006.01) |
| ***F04C 15/00*** | (2006.01) |
| ***F04C 15/06*** | (2006.01) |

(52) U.S. Cl.

CPC ..... *F04C 2/102* (2013.01); *F04C 15/008* (2013.01); *F04C 15/0088* (2013.01); *F04C 15/0096* (2013.01); *F04C 15/06* (2013.01); *F04C 2210/20* (2013.01); *F04C 2210/206* (2013.01); *F04C 2240/30* (2013.01); *F04C 2240/40* (2013.01); *F04C 2240/60* (2013.01)

(58) Field of Classification Search

CPC .. F04C 15/0088; F04C 15/0096; F04C 15/06; F04C 2210/20; F04C 2210/206; F04C 2240/30; F04C 2240/40; F04C 2240/60

See application file for complete search history.

(56) References Cited

U.S. PATENT DOCUMENTS

| | | | | |
|---|---|---|---|---|
| 7,927,079 | B2 * | 4/2011 | Suzuki | F04C 11/008 318/400.11 |
| 8,038,423 | B2 * | 10/2011 | Nakayoshi | F04C 15/0026 418/171 |
| 10,302,081 | B2 * | 5/2019 | Yamamoto | F04C 11/008 |
| 2018/0238325 | A1 * | 8/2018 | Ando | F04C 2/10 |
| 2019/0003477 | A1 | 1/2019 | Graves et al. | |
| 2019/0277294 | A1 * | 9/2019 | Hoshiko | F04D 13/0686 |
| 2022/0416618 | A1 | 12/2022 | Sakata et al. | |
| 2024/0060490 | A1 | 2/2024 | Graves et al. | |

FOREIGN PATENT DOCUMENTS

| | | | |
|---|---|---|---|
| JP | 2023005537 | A | 1/2023 |
| JP | 2023055912 | A | 4/2023 |

* cited by examiner

ELECTRIC LIQUID PUMP

CROSS-REFERENCE TO RELATED APPLICATIONS

This application is based on and claims priority under 35 USC 119 from Japanese Patent Application No. 2024-044307 filed on Mar. 20, 2024, the entire content of which is incorporated herein by reference.

TECHNICAL FIELD

The present disclosure relates to an electric liquid pump that transports a liquid such as oil.

BACKGROUND ART

As an electric liquid pump that transports a liquid such as oil, there has been an electric liquid pump including an electric motor that is a drive source, and an inner rotor and an outer rotor that are connected to a shaft of the electric motor and achieve a pump function (for example, see JP2023-055912A, JP2023-004065A, JP2023-005537A, and JP2020-165375A).

In this type of electric liquid pump, when the shaft of the electric motor rotates, the inner rotor integrated with the shaft rotates. Further, as the inner rotor rotates, the outer rotor meshing with the inner rotor rotates. Accordingly, the pump function of suctioning and discharging a liquid is achieved.

In general, the electric liquid pump is provided with an attachment portion for attaching the electric liquid pump to a counterpart member which is a target to which a liquid is supplied from the electric liquid pump or a target from which a liquid is supplied to the electric liquid pump.

For example, in each of electric liquid pumps introduced in JP2023-055912A and JP2023-004065A, an attachment portion is disposed in the vicinity of an electric motor in the electric liquid pump.

More specifically, each of the electric liquid pumps introduced in JP2023-055912A and JP2023-004065A includes the electric motor and a liquid pump accommodated in a case, and a control board connected to the electric motor is disposed in the vicinity of the electric motor and outside the case. The control board is sandwiched between the case and a cover, and the attachment portion is formed on the cover.

Here, in a general electric liquid pump, various three-dimensional structure portions are provided in the vicinity of an electric motor. Therefore, a portion in the vicinity of the electric motor in the electric liquid pump may be referred to as a bulky portion.

In each of the electric liquid pumps introduced in JP2023-055912A and JP2023-004065A, the cover is also provided with three-dimensional structure portions such as a fin for heat dissipation and a connector portion that connects the control board to an external power source. Therefore, the cover is bulky.

In each of the electric liquid pumps introduced in JP2023-055912A and JP2023-004065A, since the attachment portion is provided on the bulky cover as described above, there is a problem that a degree of freedom in arrangement of the attachment portion is significantly low. Further, the cover is considered to be made of metal because the fin for the heat dissipation is provided, and has a large mass. There is also a problem that a mass of the electric liquid pump is further increased by further providing the attachment portion on the cover having such a large mass.

In an electric liquid pump introduced in JP2023-005537A, attachment portions are formed on side surfaces thereof. The attachment portions are formed of a part of the case. In the electric liquid pump introduced in JP2023-005537A, the attachment portions are provided on both an electric motor side and a liquid pump side. Therefore, the electric liquid pump introduced in JP2023-005537A also has a problem in that a degree of freedom of arrangement regarding the attachment portions is poor, similarly to the electric liquid pumps introduced in JP2023-055912A and JP2023-004065A described above.

Although the attachment portions in the electric liquid pump introduced in JP2023-005537A are formed of a part of the case, since the case is made of metal, a mass of the electric liquid pump increases by further providing the attachment portions in the metal case, and there is also a problem that it is difficult to reduce a weight of the electric liquid pump.

In an electric liquid pump introduced in JP2020-165375A, an attachment portion is disposed on a liquid pump side in a case. However, in the electric liquid pump introduced in JP2020-165375A, the case is also made of metal and has a large mass. Therefore, the technique also increases a mass of the entire electric liquid pump by further providing the attachment portion in the metal case having such a large mass, and does not solve the problem that it is difficult to reduce a weight of the electric liquid pump.

Further, the case in the electric liquid pump introduced in JP2020-165375A is divided into a motor housing which is a portion on an electric motor side and a pump body which is a portion on a pump side. JP2020-165375A does not mention an attachment structure of the motor housing and the pump body. However, in the electric liquid pump, there is a problem that the mass of the entire electric liquid pump is further increased because the attachment structure of the motor housing and the pump body is required in addition to the attachment portion to the counterpart member.

Therefore, the above-described various electric liquid pumps in the related art cannot achieve sufficient reduction in size and weight, and a technique for further reducing the size and the weight of an electric liquid pump is desired.

SUMMARY OF INVENTION

An object of the present disclosure is to provide a technique capable of reducing a size and a weight of an electric liquid pump.

An aspect of the technique of the present disclosure relates to an electric liquid pump having:

- an electric motor including a motor rotor that has a shaft and a magnet portion integrated with one axial end of the shaft, and a stator that is disposed radially outside or inside the magnet portion and rotates the motor rotor;
- a liquid pump including an inner rotor that has an external tooth and is integrated with an other axial end of the shaft, and an outer rotor that has an internal tooth meshing with the external tooth and forms, together with the inner rotor, a gap volume portion into which a liquid is suctioned from a suction passage and from which the liquid is discharged toward a discharge passage;
- a motor case having a box shape and including therein a first accommodation chamber that accommodates the stator and one axial part of the motor rotor including the magnet portion, a second accommodation chamber that communicates with the first accommodation chamber and accommodates an other axial part of the motor rotor, and a partition wall that has a hole-shaped communication portion allowing the first accommodation chamber and the second accommodation chamber to communicate with each other and is provided between the first accommodation chamber and the second accommodation chamber, in which the liquid circulates through the first accommodation chamber, the second accommodation chamber, and the hole-shaped communication portion; and a body including a centering body portion inserted into the hole-shaped communication portion to be centered, a general body portion being continuous with the centering body portion and accommodated in the second accommodation chamber, and a bearing portion formed to penetrate the centering body portion and the general body portion and supporting an axial one portion of the shaft at a position between the magnet portion and the inner rotor, in which each of the motor case and the body is made of a resin, a connection body portion of the body, which is continuous with the general body portion and is on an opposite side to the centering body portion, extends in a radial direction of the shaft, and is exposed on the opposite side to the centering body portion and on an outer side in the radial direction with respect to the second accommodation chamber, a connection case portion, which is an end of the motor case on a side of the connection body portion, extends in the radial direction, and faces the connection body portion on a side of the centering body portion, and the connection body portion and the connection case portion are provided with attachment portions having a through-hole-shape at positions facing each other.

According to the technique of the present disclosure, an electric liquid pump can be reduced in size and weight.

BRIEF DESCRIPTION OF DRAWINGS

Exemplary embodiment(s) of the present invention will be described in detail based on the following figures, wherein.

DESCRIPTION OF EMBODIMENTS

Figure 1:
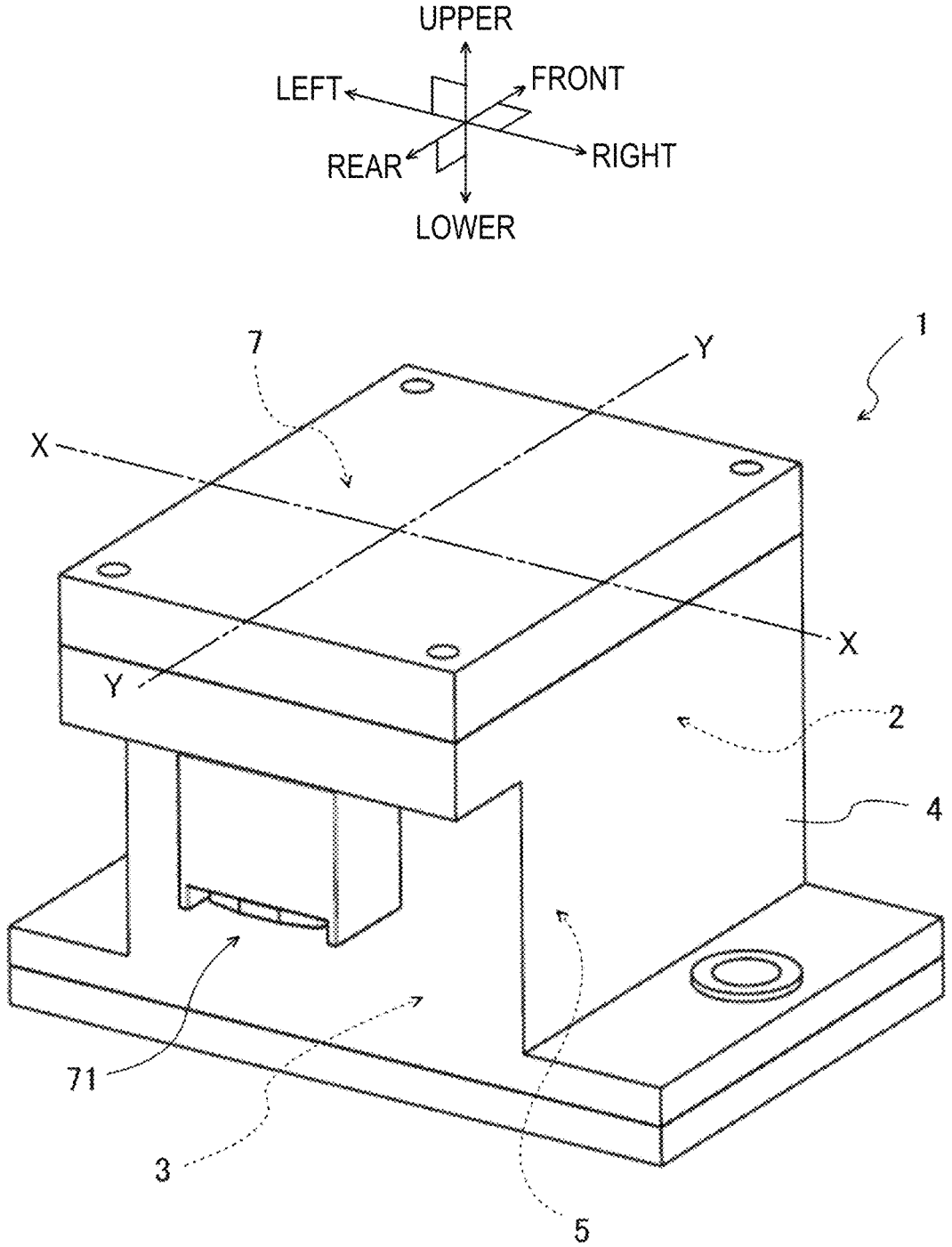
FIG. 1 is a diagram schematically illustrating an appearance of an electric liquid pump according to a first example.

Hereinafter, the electric liquid pump according to the present disclosure will be described with reference to specific examples.

The electric liquid pump according to the present disclosure includes a motor rotor, a stator, an inner rotor, an outer rotor, a motor case, and a body. The inner rotor and the outer rotor among these members form a liquid pump, and the motor rotor and the shaft form an electric motor that drives the liquid pump.

The motor case and the body function as a housing that accommodates therein at least a part of the liquid pump and the electric motor.

Among these members, the body also functions as a support mechanism that supports the liquid pump and the electric motor.

Incidentally, as described above, in the electric liquid pump in the related art, a metal case portion is used as a case portion.

In contrast, in the electric liquid pump according to the present disclosure, a resin material is used as materials for the motor case and the body constituting the case. Since the resin material is lighter than metal, the electric liquid pump according to the present disclosure is greatly reduced in weight as a whole.

In the electric liquid pump according to the present disclosure, attachment portions having a through-hole-shape are respectively provided in a connection body portion of the body and a connection case portion of the motor case. The connection body portion is an end of the body on an opposite side to a centering body portion (in other words, a liquid pump side), extends in a radial direction of the shaft, and is exposed on the opposite side to the centering body portion and an outer side in the radial direction with respect to a second accommodation chamber. Further, the connection case portion is an end of the motor case on a connection body portion side (in other words, a liquid pump side), extends in the radial direction like the connection body portion, and faces the connection body portion on a centering body portion side. In other words, the connection body portion and the connection case portion face each other on the outer side in the radial direction with respect to the second accommodation chamber and on an outer side of the liquid pump side. Further, the connection body portion and the connection case portion are formed with the attachment portions having the through-hole-shape at positions facing each other.

In the electric liquid pump according to the present disclosure, since the attachment portions are provided on the liquid pump side as described above, the attachment portions have a greater degree of freedom in arrangement than when the attachment portions are provided on an electric motor side.

The attachment portions are provided at the positions facing each other on the connection body portion and the connection case portion, and has the through-hole shape. Therefore, the attachment portion not only functions as an attachment portion for the electric liquid pump to a counterpart member, but also functions as a connection portion between the motor case and the body. That is, in the electric liquid pump according to the present disclosure, only one attachment portion is required to be provided instead of providing two portions, that is, the attachment portion of the electric liquid pump to the counterpart member and the connection portion between the motor case and the body.

Therefore, an outer shape of the electric liquid pump according to the present disclosure can be reduced, whereby the entire electric liquid pump is further reduced in size and weight.

In addition, in the electric liquid pump according to the present disclosure, the liquid circulates inside the motor case. Therefore, for example, it is not necessary to liquid-tightly seal the electric motor side and the liquid pump side in the case, and a seal mechanism can be simplified. Accordingly, the electric liquid pump according to the present disclosure is further reduced in size and weight.

Hereinafter, the electric liquid pump according to the present disclosure will be described for each component.

In the present specification, when a radial direction and an axial direction are simply mentioned, the radial direction and the axial direction mean a radial direction and an axial direction of the shaft of the electric motor.

Unless otherwise specified, a numerical range "x to y" described in the present specification includes a lower limit value x and an upper limit value y. The upper limit value, the lower limit value, and numerical values listed in the examples may be freely combined to form a numerical value range. Further, numerical values freely selected from the numerical value range can be set as an upper limit numerical value and a lower limit numerical value.

The electric liquid pump according to the present disclosure is a pump that transports a liquid such as oil and various coolants, and can be embodied, for example, as a pump mounted on a vehicle for supplying oil to a drive system such as a transmission. The electric liquid pump according to the present disclosure may be a small pump mounted on a vehicle or the like, or may be a stationary pump installed in various facilities or the like.

The electric motor includes the shaft, a magnet portion, and the stator. The electric motor in the electric liquid pump according to the present disclosure may be an inner rotor type motor in which a stator is disposed radially outside of a motor rotor, or an outer rotor type motor in which a stator is disposed radially inside of a motor rotor.

The shaft is a long member that constitutes a rotating shaft of the motor rotor, and it is preferable that a material used for the shaft is one that is difficult to deform.

The shaft may be made of a magnetic material or a non-magnetic material, but is preferably made of a magnetic material in order to function as a back yoke for the magnet portion.

The shaft may have a constant shape in radial cross section, or may have a T-shaped cross section with a sleeve having a larger diameter than other portions at one axial end, that is, a portion integrated with the magnet portion. When the shaft includes the sleeve, the magnet portion is integrated with the sleeve. Therefore, when the sleeve is provided on the shaft, the above function as the back yoke can be effectively exerted, and there is also an advantage that the magnet portion can be made smaller by an amount of the sleeve.

The magnet portion may be a permanent magnet that can generate a magnetic field, or any one, and for example, a bonded magnet may be used as the magnet portion.

The bonded magnet is a magnet made by bonding magnetic powder with a binder. The magnetic powder may be any known material such as SmFeN-based magnetic powder, ferrite-based magnetic powder, or neodymium-based magnetic powder.

By using the bonded magnet as the magnet portion, it is possible to reduce the mass of the magnet portion by an amount of the binder.

Incidentally, in the electric liquid pump including the motor rotor having a large rotational torque, a bearing portion including a metal bearing is required as a bearing that supports the shaft of the electric motor.

The bearing is a mechanism that smoothly rotates the shaft, and for example, a rolling bearing type bearing, which is a general bearing, has a three-layer structure of an inner ring, a ball, and an outer ring, and is a member having a relatively large mass. Therefore, it is difficult to reduce the weight of the electric liquid pump including the bearing in the bearing portion.

The bearing portion in the electric liquid pump according to the present disclosure is formed to penetrate the centering body portion and a general body portion in the body made of the resin. Further, in the electric liquid pump according to the present disclosure, the shaft of the electric motor is supported by the bearing portion. Furthermore, in the electric liquid pump according to the present disclosure, the liquid suctioned and discharged by the liquid pump circulates inside the motor case. Since the liquid is also supplied between the body and the shaft, the liquid can function as a lubricant.

In the electric liquid pump according to the present disclosure, by circulating the liquid inside the motor case, it is possible to rotate the shaft smoothly, even though a part of the body made of the resin, which is lighter than the metal, is used instead of the bearing. In other words, in the electric liquid pump according to the present disclosure, the motor rotor smoothly rotates without using a metal bearing or the like as the bearing portion that supports the shaft of the electric motor. Accordingly, the electric liquid pump according to the present disclosure can also achieve reduction in weight.

When a magnet portion made of the bonded magnet is used as the magnet portion of the motor rotor, the rotational torque of the motor rotor is further reduced, which has the advantage that the shaft rotates even more smoothly.

In the electric liquid pump according to the present disclosure, a method for integrating the magnet portion and the shaft is not particularly limited, and for example, the magnet portion and the shaft may be integrated at the time of molding by insert molding or the like, or a magnet portion molded in advance may be fixed to the shaft using a method such as adhesion.

The stator is a portion that generates a force for rotating a rotor, and a stator having a known structure, such as a stator in which a coil is wound around a core, may be used.

The liquid pump includes the inner rotor and the outer rotor.

The inner rotor includes external teeth and is integrated with the other axial end of the shaft. Therefore, the inner rotor rotates together with the shaft.

The outer rotor includes internal teeth that mesh with the external teeth of the inner rotor. In other words, the inner rotor is disposed inside the outer rotor, and the outer rotor rotates following rotation of the inner rotor.

A gap volume portion is formed between the inner rotor and the outer rotor. As the inner rotor and the outer rotor rotate, the liquid is suctioned from a suction passage outside the electric liquid pump toward the gap volume portion, and the liquid is discharged from the gap volume portion toward a discharge passage outside the electric liquid pump.

Shapes of the inner rotor and the outer rotor for forming the gap volume portion may be general shapes used for the liquid pump.

Specifically, in a general oil pump, an inner rotor and an outer rotor mesh with each other in an eccentric manner. The inner rotor includes a plurality of external teeth. The outer rotor is located radially outside the inner rotor and includes the internal teeth that mesh with the external teeth of the inner rotor. The number of internal teeth of the outer rotor is different from the number of external teeth of the inner rotor.

When the shaft rotates, the inner rotor integrated with the shaft rotates integrally with the shaft. Thus, the outer rotor, which meshes with the inner rotor, rotates eccentrically relative to the inner rotor. When such rotation occurs, volumes of a plurality of gap volume portions formed between the inner rotor and the outer rotor change sequentially by repeatedly decreasing and increasing. Accordingly, oil is suctioned up by a negative pressure from the suction passage outside the electric liquid pump to the gap volume portion, and the oil is pumped by compression from the gap volume portion to the discharge passage outside the electric liquid pump.

The inner rotor and the outer rotor may have any general shape that can perform the above-mentioned pump function.

In the electric liquid pump according to the present disclosure, materials for the inner rotor and the outer rotor are not particularly limited, and may be made of metal such as aluminum or may be made of a resin.

At least one of the inner rotor and the outer rotor is preferably made of a resin, and among the resins, it is particularly preferable that the rotor is made of a thermosetting resin. Hereinafter, the one of the inner rotor and the outer rotor, which is made of the resin, may be referred to as a resin rotor as necessary.

By using the resin rotor as at least one of the inner rotor and the outer rotor, it is possible to reduce a weight of the resin rotor and thus the weight of the electric liquid pump itself.

In particular, by using the thermosetting resin as the material for the resin rotor, it is possible to reduce a manufacturing cost of the resin rotor while maintaining heat resistance thereof.

The materials for the inner rotor and the outer rotor may be the same or different. The inner rotor and the outer rotor are preferably the resin rotors. The thermosetting resin that can be used as the materials for the inner rotor and the outer rotor will be described in detail later.

In the electric liquid pump according to the present disclosure, the case that accommodates the electric motor and the liquid pump includes the motor case and the body.

The motor case and the body are made of the resin material. The resin material for the motor case and the body will be described in detail later.

The motor case is a box-shaped member that accommodates the motor rotor including the magnet portion, the stator, and the body.

The motor case has a first accommodation chamber and a second accommodation chamber therein, and includes a partition wall between the first accommodation chamber and the second accommodation chamber. The partition wall is provided with a hole-shaped communication portion that allows the first accommodation chamber and the second accommodation chamber to communicate with each other. The partition wall may have a passage that allows the first accommodation chamber and the second accommodation chamber to communicate with each other in addition to the hole-shaped communication portion.

The magnet portion, the stator, and the one axial end of the shaft integrated with the magnet portion are accommodated in the first accommodation chamber. In other words, the stator and one axial part of the motor rotor are accommodated in the first accommodation chamber. The first accommodation chamber can also be regarded as a motor chamber that accommodates a portion of the electric liquid pump according to the present disclosure which functions as the electric motor.

The second accommodation chamber accommodates the other axial part of the shaft, that is, the other axial part of the motor rotor. Further, the second accommodation chamber accommodates the general body portion that is a part of the body. For the convenience of accommodating the body, and because, as described above, the connection case portion of the motor case and the connection body portion of the body are integrated by the attachment portions on the outer side in the radial direction with respect to the second accommodation chamber and on the outer side of the liquid pump side, an end of the second accommodation chamber opposite to the first accommodation chamber is opened. Hereinafter, the opening is referred to as a case opening as necessary.

As described above, the first accommodation chamber and the second accommodation chamber are partitioned by the partition wall and communicate with each other by the hole-shaped communication portion. Therefore, one portion of the motor rotor between a portion accommodated in the first accommodation chamber and the other axial portion accommodated in the second accommodation chamber may be said to be accommodated in the hole-shaped communication portion. Specifically, this portion is a portion of the shaft between the one axial end and the other axial end.

The body includes the centering body portion and the general body portion. The centering body portion is a portion that is inserted into the hole-shaped communication portion and performs centering of the body with respect to the motor case, and an outer shape of the centering body portion substantially matches a hole shape of the hole-shaped communication portion.

The general body portion is a portion continuous with the centering body portion and is accommodated in the second accommodation chamber of the motor case.

The bearing portion is formed to penetrate the centering body portion and the general body portion. The bearing portion is a simple through hole including no bearing or the like. However, an oil groove that improves lubricity between the shaft and the bearing portion may be provided in the bearing portion.

In the electric liquid pump according to the present disclosure, a portion of the shaft of the motor rotor between the one end and the other end, that is, a portion that is not integrated with the magnet portion or the inner rotor is accommodated in the bearing portion formed to penetrate the centering body portion and the general body portion.

The inner rotor is integrated with the other axial end side of the shaft of the motor rotor.

The inner rotor may be disposed outside the body, but is preferably disposed inside the body in order to reduce the size and the weight of the electric liquid pump according to the present disclosure.

That is, it is preferable that a rotor accommodation chamber that accommodates the inner rotor and the outer rotor is provided at an end of the general body portion opposite to the centering body portion. The rotor accommodation chamber communicates with the bearing portion due to a positional relationship among the shaft, the inner rotor, and the outer rotor.

When the general body portion has the rotor accommodation chamber that accommodates the inner rotor and the outer rotor, it is preferable that the inner rotor and the outer rotor are also accommodated in the motor case together with the general body portion.

In the electric liquid pump according to the present disclosure, the body and the motor case are further centered and integrated at the connection body portion of the body and the connection case portion of the motor case in a state in which the centering body portion is inserted into the hole-shaped communication portion and centered. The connection body portion extends in the radial direction, and is exposed on the opposite side to the centering body portion and the outer side in the radial direction with respect to the second accommodation chamber. Therefore, when the body and the motor case are integrated, it can be said that the general body portion closes the case opening of the second accommodation chamber.

Further, since the connection body portion and the connection case portion are located on the outer side in the radial direction with respect to the second accommodation chamber, the connection body portion and the connection case portion can also be said to be located on a peripheral edge portion of the case opening. Further, it can be said that the general body portion and the motor case are also centered at the peripheral edge portion of the case opening.

Further, the attachment portions provided in the connection body portion and the connection case portion function as the attachment portion for attaching the electric liquid pump according to the present disclosure to the counterpart member, that is, an oil pan for supplying the liquid to the liquid pump, or a target to which the liquid is supplied from the liquid pump, for example, a transmission. Accordingly, a structure for integrating the body and the motor case in the electric liquid pump according to the present disclosure and a structure for attaching the electric liquid pump according to the present disclosure to the counterpart member can be formed into simple and non-bulky shapes. Accordingly, the electric liquid pump according to the present disclosure is further reduced in size and weight.

The attachment portion of the connection case portion and the attachment portion of the connection body portion may have the same diameter or different diameters.

Incidentally, the suction passage and the discharge passage of the electric liquid pump are located on the liquid pump side. Therefore, when the electric liquid pump is connected to the counterpart member, the liquid pump is directed toward the counterpart member. Since the connection body portion is located closer to the liquid pump than the connection case portion, the electric liquid pump according to the present disclosure can be said to direct the connection body portion toward the counterpart member.

As a method for attaching the electric liquid pump according to the present disclosure to the counterpart member, it is preferable to select a method for bolting the electric liquid pump to the counterpart member in consideration of attaching workability and a cost. In order to bolt the electric liquid pump to the counterpart member, a bolt is inserted through the through-hole-shaped attachment portions of the connection case portion and the connection body portion. More specifically, at this time, the bolt is inserted from the attachment portion of the connection case portion toward the attachment portion of the connection body portion so that a tip of the bolt is directed toward the counterpart member.

When the bolt is fastened to the counterpart member, a head of the bolt is pressed against a peripheral edge portion of the attachment portion in the connection case portion. Therefore, in order to ensure strength of the bolting, it is preferable to reinforce the attachment portion of the connection case portion.

Specifically, it is preferable that a hole diameter of the attachment portion of the connection case portion is larger than a hole diameter of the attachment portion of the connection body portion, and a hard collar portion is embedded in the attachment portion of the connection case portion.

The collar portion may have a tubular shape, but more preferably includes a flange exposed on a surface on a connection case portion side and/or a surface opposite to the connection case portion. The flange may have a brim shape that extends radially from the attachment portion of the connection case portion.

As described above, in the electric liquid pump according to the present disclosure, the motor case and the body are made of the resin material.

Among these members, the body is required to have high durability since the bearing portion that supports the shaft is provided. Further, the body is exposed to the liquid. Therefore, as the material for such a body, it is preferable to select the thermosetting resin excellent in resistance to deterioration and infiltration by the liquid suctioned in and discharged by the electric liquid pump according to the present disclosure, and seizure resistance and sliding properties of the bearing portion. For example, when the electric liquid pump according to the present disclosure is an oil pump for a vehicle, a phenol resin is preferably used as the thermosetting resin.

The motor case is not loaded as much as the body. Therefore, as the material for the motor case, an inexpensive material inferior to the material for the body in the above-described various characteristics can be selected. For example, the motor case may be made of a thermoplastic resin, and among these, it is more preferable to use an engineering plastic such as polyphenylene sulfide (PPS). This is because the engineering plastic is excellent in various characteristics among thermoplastic resins. A specific gravity of PPS is larger than that of the phenol resin. However, the motor case does not require as much rigidity as the body. Therefore, a thickness of the motor case may be smaller than that of the body, so that a material having a specific gravity larger than that of the material for the body can be used as the material for the motor case. Even though PPS has a larger specific gravity than the phenol resin, the specific gravity is far smaller than that of the metal. For reference, the specific gravity of aluminum is 2.7, the specific gravity of the phenol resin is approximately 1.24 to 1.32, and the specific gravity of PPS is approximately 1.35.

In order to reduce the weight of the electric liquid pump according to the present disclosure, the inner rotor and the outer rotor are also preferably made of the thermosetting resin. The materials for the inner rotor and the outer rotor may be the same or different.

Further, the materials for the inner rotor and the outer rotor may be the same as or different from that for the body.

The thermosetting resin used as the material for the body and, if necessary, the material for the inner rotor and/or the outer rotor is not particularly limited, but is preferably a phenol resin as described above.

In the present disclosure, the term "made of a thermosetting resin" includes not only those made of only thermosetting resin, but also those made of a mixed material of a thermosetting resin and various compounding agents.

The compounding agent referred to here means a material other than the thermosetting resin, and examples thereof include reinforcing fibers such as a glass fiber and a carbon fiber, various inorganic fillers typified by glass beads and mineral powders such as talc and mica, defoamers, and various additives such as pigments.

An amount of the compounding agent with respect to the thermosetting resin is not particularly limited, but is preferably, for example, 90% by mass or less, 70% by mass or less, or 50% by mass or less with respect to 100% by mass of the thermosetting resin.

Hereinafter, the electric liquid pump according to the present disclosure will be described with reference to specific examples.

First Example

An electric liquid pump according to a first example is mounted on a vehicle to suction up oil from an oil pan and supply the oil to a drive system such as a transmission, and a liquid in the electric liquid pump is the oil.

Figure 2:
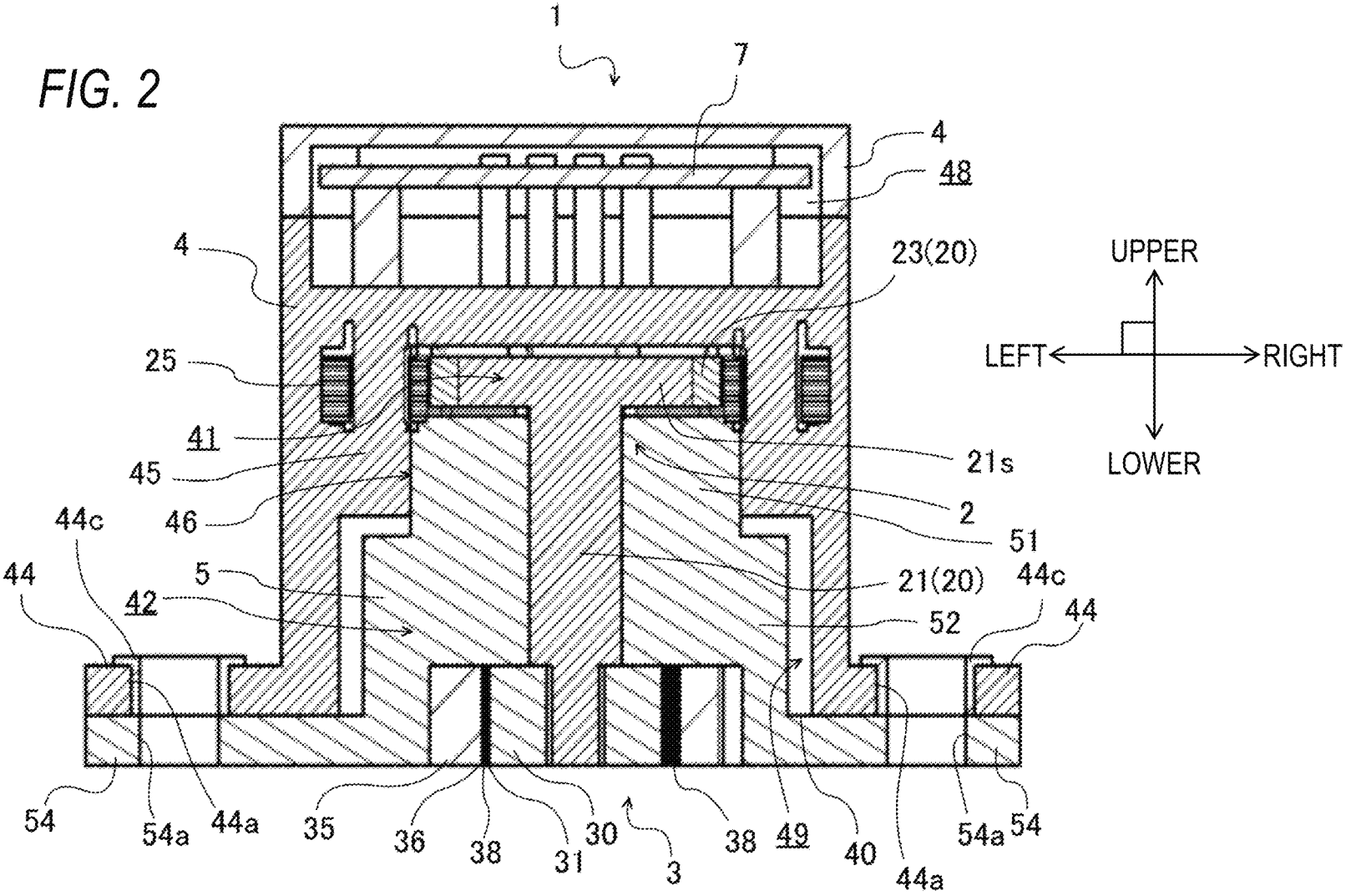
FIG. 2 is a diagram schematically illustrating a state in which the electric liquid pump according to the first example is cut at an X-X position in FIG. 1.
Figure 3:
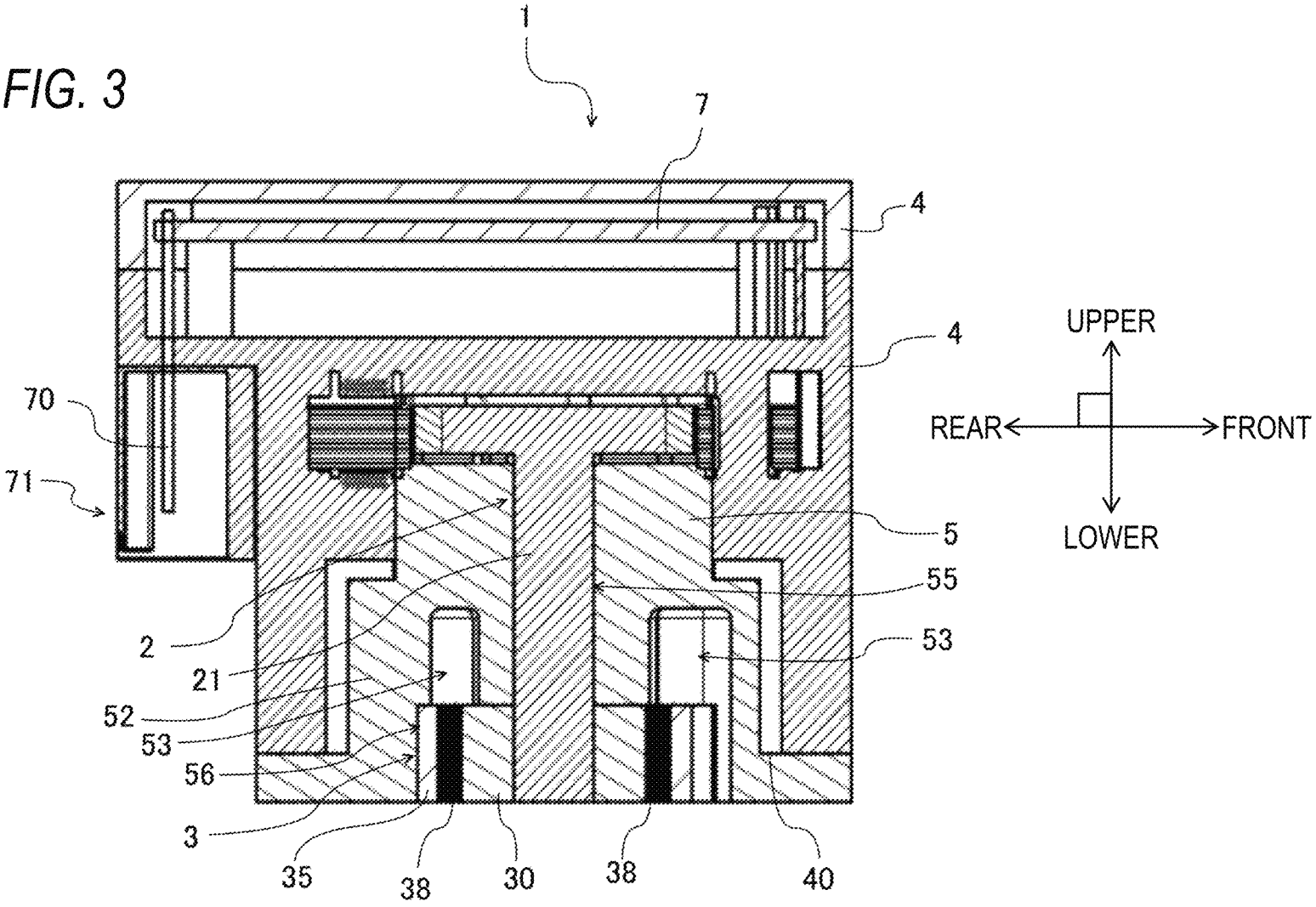
FIG. 3 is a diagram schematically illustrating a state in which the electric liquid pump according to the first example is cut at a Y-Y position in FIG. 1.

FIG. 1 shows a diagram schematically illustrating an appearance of the electric liquid pump according to the first example. FIG. 2 shows a diagram schematically illustrating a state in which the electric liquid pump according to the first example is cut at an X-X position in FIG. 1. FIG. 3 shows a diagram schematically illustrating a state in which the electric liquid pump according to the first example is cut at a Y-Y position in FIG. 1.

Hereinafter, upper, lower, left, right, front, and rear in the first example mean upper, lower, left, right, front, and rear shown in the drawings. An upper-lower direction coincides with the axial direction of the motor rotor.

As shown in FIGS. 1 to 3, an electric liquid pump 1 according to the first example includes an electric motor 2, a liquid pump 3, a motor case 4, and a body 5.

As shown in FIGS. 2 and 3, the electric motor 2 includes a motor rotor 20 and a stator 25.

The motor rotor 20 includes a shaft 21 and a magnet portion 23, and an axial cross section thereof is substantially T-shaped.

Among these members, the shaft 21 is a long member made of magnetic metal, and includes a sleeve 21*s* having a larger diameter than other portions at one axial end thereof.

The magnet portion 23 is a bonded magnet, is integrated with an outer peripheral surface of the sleeve 21*s*, and extends further radially outside the sleeve 21*s*.

The stator 25 is disposed further radially outward from the magnet portion 23. A control board 7 is connected to the stator 25 via a lead wire (not shown).

As shown in FIG. 3, a lead wire 70 is further connected to the control board 7 and directed toward an outside of the electric liquid pump 1. An end of the lead wire 70 forms a connection terminal portion 71 that supplies power to the electric motor 2 according to the first example and inputs and outputs signals.

The liquid pump 3 includes an inner rotor 30 and an outer rotor 35. The inner rotor 30 and the outer rotor 35 are made of a phenol resin.

The inner rotor 30 includes external teeth 31 and is integrated with the other axial end of the shaft 21, that is, a lower end in FIGS. 2 and 3. Since the inner rotor 30 is integrated with the shaft 21 of the motor rotor 20, when the motor rotor 20 rotates due to action of the stator 25 and the magnet portion 23, the inner rotor 30 rotates together with the motor rotor 20.

The outer rotor 35 includes internal teeth 36 that mesh with the external teeth 31 of the inner rotor 30, and is disposed outside the inner rotor 30 so as to surround the inner rotor 30.

A gap volume portion 38 that achieves a pump function is formed between the inner rotor 30 and the outer rotor 35.

The motor case 4 is made of a polyphenylene sulfide resin containing reinforcing fibers, is box-shaped, and has a case opening 40 that opens downward. A first accommodation chamber 41 and a second accommodation chamber 42 are provided inside the motor case 4. Inside the motor case 4, the first accommodation chamber 41 is disposed on an upper side, the second accommodation chamber 42 is disposed on a lower side, and a partition wall 45 is provided between the first accommodation chamber 41 and the second accommodation chamber 42.

The partition wall 45 is provided with a hole-shaped communication portion 46 having a through-hole shape penetrating the partition wall 45 in the upper-lower direction, which is a thickness direction thereof. In the electric liquid pump 1 according to the first example, a hole diameter of the hole-shaped communication portion 46 is substantially the same as an inner diameter of the first accommodation chamber 41.

An upper portion of the motor rotor 20 including the magnet portion 23 and the stator 25 are accommodated in the first accommodation chamber 41 of the motor case 4. The stator 25 is disposed radially outside the magnet portion 23 so as to surround the magnet portion 23.

An inner portion of the stator 25, that is, a portion of the stator 25 on a motor rotor 20 side is exposed to the first accommodation chamber 41. An outer portion of the stator 25 is located outside the first accommodation chamber 41 and enters a wall portion of the motor case 4.

In the electric liquid pump 1 according to the first example, a portion of the motor case 4 above the first accommodation chamber 41 is divided into upper and lower portions, and a board chamber 48 is formed between the upper and lower portions.

The board chamber 48 is liquid-tightly isolated from the first accommodation chamber 41 and the second accommodation chamber 42, and the control board 7 for the stator 25 is disposed in the board chamber 48. The control board 7 is electrically connected to the stator 25 by a lead wire extending from the first accommodation chamber 41 to the board chamber 48. Therefore, a communication path (not shown) through which the lead wire passes is formed in a portion between the first accommodation chamber 41 and the board chamber 48 in the motor case 4. However, a gap between the communication path and the lead wire is liquid-tightly sealed at a boundary portion between the first accommodation chamber 41 and the board chamber 48. Therefore, the board chamber 48 in the electric liquid pump 1 according to the first example is liquid-tightly isolated from the first accommodation chamber 41 and the second accommodation chamber 42.

The hole-shaped communication portion 46 and the second accommodation chamber 42 are continuous, and a portion of the motor rotor 20 other than a portion accommodated in the first accommodation chamber 41 is accommodated in the hole-shaped communication portion 46 or the second accommodation chamber 42.

The body 5 is made of a phenol resin.

A centering body portion 51, which is a part of the body 5, is inserted into the hole-shaped communication portion 46. An outer shape of the centering body portion 51 is substantially the same as a hole shape of the hole-shaped communication portion 46, whereby the centering body portion 51 is fitted to the hole-shaped communication portion 46 and centered, that is, positioned with respect to the partition wall 45 and the motor case 4.

An upper portion of a general body portion 52 continuous with the centering body portion 51 is accommodated in the second accommodation chamber 42 continuous with the hole-shaped communication portion 46. An outer shape of the upper portion of the general body portion 52 is slightly smaller than an inner shape of the second accommodation chamber 42, and a small space 49 is formed in the second accommodation chamber 42 at a portion outside the general body portion 52. The space 49 functions as an oil circulation space.

Further, as shown in FIG. 3, a plurality of recesses 53 are formed inside the general body portion 52. An inside of each of the recesses 53 communicates with the gap volume portion 38 formed between the inner rotor 30 and the outer rotor 35.

A bearing portion 55 is formed to penetrate the centering body portion 51 and the general body portion 52. The bearing portion 55 is a through hole extending in the upper-lower direction. A central portion of the shaft 21 of the motor rotor 20 is supported by the bearing portion 55. More specifically, an axial central portion of the shaft 21 of the motor rotor 20 is inserted into the through-hole-shaped bearing portion 55 provided in the body 5, and as a result, the bearing portion 55 supports the entire shaft 21, the magnet portion 23 integrated with the one axial end of the shaft 21, and the inner rotor 30 integrated with the other axial end of the shaft 21.

The inner rotor 30 is integrated with the lower end of the shaft 21 of the motor rotor 20. The inner rotor 30 is accommodated together with the outer rotor 35 in a rotor accommodation chamber 56 provided at an end of the general body portion 52 opposite to the centering body portion 51.

The rotor accommodation chamber 56 is larger than the bearing portion 55, is located below the bearing portion 55, and accommodates with the bearing portion 55. A lower portion of the rotor accommodation chamber 56 is opened. Further, there are the recesses 53 on an upper side of the rotor accommodation chamber 56, and the inside of each of the recesses 53 communicates with the rotor accommodation chamber 56. As described above, since the inner rotor 30 and the outer rotor 35 are accommodated in the rotor accommodation chamber 56, it can be said that the inside of the recess 53 also communicates with the gap volume portion 38 formed between the inner rotor 30 and the outer rotor 35 via the rotor accommodation chamber 56.

A connection body portion 54, which is a lower end of the body 5, is larger than the second accommodation chamber 42, extends in the radial direction perpendicular to the upper-lower direction, that is, the axial direction, and is exposed below and radially outward from the motor case 4 through the case opening 40.

A lower end of the motor case 4, in other words, a connection case portion 44 which is an end of the motor case 4 on a connection body portion 54 side extends in the radial direction perpendicular to the upper-lower direction, that is, the axial direction. The connection case portion 44 may also be referred to as a peripheral edge portion of the case opening 40.

As shown in FIG. 2, the connection body portion 54 and the connection case portion 44 face each other. Further, in the connection body portion 54 and the connection case portion 44, attachment portions (attachment portion 54*a* of the connection body portion 54 and attachment portion 44*a* of the connection case portion 44) having a through-hole-shape are formed at positions facing each other. The attachment portion 54*a* of the connection body portion 54 and the attachment portion 44*a* of the connection case portion 44 communicate with each other. A hole diameter of the attachment portion 44*a* of the connection case portion 44 is larger than a hole diameter of the attachment portion 54*a* of the connection body portion 54, and a hard collar portion 44*c* is embedded in the attachment portion 44*a* of the connection case portion 44.

A bolt (not shown) is inserted into the attachment portion 54*a* of the connection body portion 54 and the attachment portion 44*a* of the connection case portion 44, and the bolt is fastened to a nut (not shown) on a counterpart member side (not shown). Accordingly, the motor case 4 and the body 5 are attached to the counterpart member, and the motor case 4 and the body 5 are also attached to each other. At this time, a lower end of the general body portion 52 can be said to close the case opening 40.

In the electric liquid pump 1 according to the first example, the inner rotor 30, the outer rotor 35, and the body 5 are made of the phenol resin, which is a kind of the thermosetting resin, and the motor case is made of PPS, which is a kind of thermoplastic resin. Therefore, the electric liquid pump 1 according to the first example is lightweight.

In the electric liquid pump 1 according to the first example, the attachment portion 54*a* of the connection body portion 54 and the attachment portion 44*a* of the connection case portion 44 are provided at the positions on a liquid pump 3 side in the electric liquid pump 1. Therefore, compared to a case in which the attachment portion 54*a* and the attachment portion 44*a* are provided on an electric motor 2 side, the degree of freedom in arrangement of the attachment portion 54*a* and the attachment portion 44*a* is excellent.

The electric liquid pump 1 according to the first example is attached to the counterpart member (not shown) and the motor case 4 and the body 5 are integrated by the attachment portion 54*a* and the attachment portion 44*a*. Accordingly, the electric liquid pump 1 according to the first example is further reduced in size and weight.

In addition, in the electric liquid pump 1 according to the first example, the liquid circulates inside the motor case 4. Therefore, it is not necessary to liquid-tightly seal the first accommodation chamber 41 which is a space on the electric motor 2 side and the second accommodation chamber 42 which is a space on a liquid pump 3 side inside the motor case 4. Therefore, according to the electric liquid pump 1 of the first example, a seal mechanism can be simplified, and further reduction in size and weight of the electric liquid pump 1 can be achieved.

The electric liquid pump 1 according to the first example does not require a bearing that supports the shaft 21. Accordingly, the electric liquid pump 1 according to the first example is small and light.

Further, in the electric liquid pump according to the first example, the body 5 has a function of accommodating the liquid pump 3 and a function of supporting the liquid pump 3 and the electric motor 2. Since the body 5 has many functions as described above, the number of components in the electric liquid pump 1 according to the first example is reduced, and thus the number of steps of manufacturing the electric liquid pump 1 is reduced, and a manufacturing cost of the electric liquid pump 1 is reduced.

Further, sintered metal generally used as the materials for the case, the inner rotor 30, and the outer rotor 35 is expensive and requires a special cutting process for molding, so that the case, the inner rotor 30, and the outer rotor 35 which are made of the metal are expensive, whereas the resin material is inexpensive and excellent in moldability as compared with the sintered metal. Therefore, by using the resin material as the materials for the motor case 4, the body 5, the inner rotor 30, and the outer rotor 35, manufacturing costs of the motor case 4, the body 5, the inner rotor 30, and the outer rotor 35 can be significantly reduced. Accordingly, there is also an advantage that the manufacturing cost of the electric liquid pump 1 according to the first example is significantly reduced.

As a result of the cooperation described above, the electric liquid pump 1 according to the first example can achieve the reduction in size and weight. In addition, the electric liquid pump 1 according to the first example can be manufactured at a low cost.

Although the present disclosure has been described above, the present invention is not limited to the above-described examples and the like, the elements described in the examples and the like can be appropriately extracted and combined, and various modifications can be made without departing from the scope of the present invention.

In addition, the description of the present disclosure is not limited to the citation relationships of claims at the beginning of the application, and discloses a technical idea obtained by appropriately combining the matters described in each claim.

What is claimed is:

1. An electric liquid pump comprising:

an electric motor including a motor rotor that has a shaft and a magnet portion integrated with one axial end of the shaft, and a stator that is disposed radially outside or inside the magnet portion and rotates the motor rotor;

a liquid pump including an inner rotor that has an external tooth and is integrated with an other axial end of the shaft, and an outer rotor that has an internal tooth meshing with the external tooth and forms, together with the inner rotor, a gap volume portion into which a liquid is suctioned from a suction passage and from which the liquid is discharged toward a discharge passage;

a motor case having a box shape and including therein a first accommodation chamber that accommodates the stator and one axial part of the motor rotor including the magnet portion, a second accommodation chamber that communicates with the first accommodation chamber and accommodates an other axial part of the motor rotor, and a partition wall that has a hole-shaped communication portion allowing the first accommodation chamber and the second accommodation chamber to communicate with each other and is provided between the first accommodation chamber and the second accommodation chamber, in which the liquid circulates through the first accommodation chamber, the second accommodation chamber, and the hole-shaped communication portion; and a body including a centering body portion inserted into the hole-shaped communication portion to be centered, a general body portion being continuous with the centering body portion and accommodated in the second accommodation chamber, and a bearing portion formed to penetrate the centering body portion and the general body portion and supporting an axial one portion of the shaft at a position between the magnet portion and the inner rotor, wherein each of the motor case and the body is made of a resin, a connection body portion of the body, which is continuous with the general body portion and is on an opposite side to the centering body portion, extends in a radial direction of the shaft, and is exposed on the opposite side to the centering body portion and on an outer side in the radial direction with respect to the second accommodation chamber, a connection case portion, which is an end of the motor case on a side of the connection body portion, extends in the radial direction, and faces the connection body portion on a side of the centering body portion, and the connection body portion and the connection case portion are provided with attachment portions having a through-hole-shape at positions facing each other.

2. The electric liquid pump according to claim 1, wherein a space is formed in an outer peripheral portion of the general body portion in the second accommodation chamber.

3. The electric liquid pump according to claim 1, wherein the body is made of a thermosetting resin.

4. The electric liquid pump according to claim 3, wherein the motor case is made of a thermoplastic resin.

5. The electric liquid pump according to claim 1, wherein a hole diameter of the attachment portion of the connection case portion is larger than a hole diameter of the attachment portion of the connection body portion, and a hard collar portion is embedded in the attachment portion of the connection case portion.

6. The electric liquid pump according to claim 3, wherein the thermosetting resin includes a phenol resin.

7. The electric liquid pump according to claim 6, wherein the thermosetting resin contains a reinforcing fiber and/or an inorganic filler in an amount of 30% by mass or more and 90% by mass or less when a total amount of the thermosetting resin is 100% by mass.

* * * * *